US005584603A

United States Patent [19]

Cortlever

[11] Patent Number: 5,584,603

[45] Date of Patent: Dec. 17, 1996

[54] DRAINAGE WICK INSERTING DEVICE

[75] Inventor: Nico G. Cortlever, Vinkeveen, Netherlands

[73] Assignee: Geotechnics Holland B.V., Amsterdam, Netherlands

[21] Appl. No.: 400,933

[22] Filed: Mar. 9, 1995

[30] Foreign Application Priority Data

Mar. 15, 1994 [NL] Netherlands ..... 9400401

[51] Int. Cl.[6] ..... E02D 3/10

[52] U.S. Cl. ..... 405/50; 173/147; 405/232

[58] Field of Search ..... 405/50, 232; 173/147; 175/162; 254/29 R

[56] References Cited

U.S. PATENT DOCUMENTS

| | | | |
|---|---|---|---|
| 3,154,158 | 10/1964 | Lincoln | 173/147 |
| 3,891,186 | 6/1975 | Thorsell | 254/29 R |
| 4,303,132 | 12/1981 | Weber | 173/147 |
| 4,428,699 | 1/1984 | Juhola | 405/50 |
| 4,755,080 | 7/1988 | Cortlever et al. | 405/50 |
| 5,199,507 | 4/1993 | Westmoreland | 175/147 |
| 5,213,449 | 5/1993 | Morris | 405/232 |
| 5,439,326 | 8/1995 | Goughnour et al. | 405/303 |

FOREIGN PATENT DOCUMENTS

| | | | |
|---|---|---|---|
| 0226251 | 6/1987 | European Pat. Off. . | |
| 65252 | 9/1949 | Netherlands . | |
| 7707303 | 1/1979 | Netherlands | 405/50 |
| 2220597 | 1/1990 | United Kingdom | 173/147 |

*Primary Examiner*—Hoang C. Dang
*Attorney, Agent, or Firm*—Banner & Witcoff, Ltd.

[57] ABSTRACT

A device for inserting a substantially vertical drainage wick, comprising a movable frame; an inserting lance which is provided with a passage for receiving the drainage wick and corresponding with the longitudinal axis of the inserting lance; a standing guide for the inserting lance supported by the frame; a supply mechanism for arranging the drainage wick in unwindable manner; a drive; a transmission connected to the drive; and at least on drive member coacting with the transmission, the inserting lance drive including a closed loop of a flexible element with one part of the closed loop coacting with the transmission and the other part of the loop fixed to the inserting lance.

9 Claims, 4 Drawing Sheets

DRAINAGE WICK INSERTING DEVICE

The present invention relates to a device for inserting in each case a substantially vertical drainage wick, which device comprises: a movable frame; an inserting lance which is provided with a passage for receiving the drainage wick and corresponding with the longitudinal axis of the inserting lance; a standing guide for the inserting lance supported by the frame; a supply means for arranging the drainage wick in unwindable manner; a drive; a transmission connected to the drive; and at least one drive member co-acting with the transmission.

It is known in the art to make use of a drive member embodied as cable or chain and co-acting with the transmission. The inserting lance is herein driven by making use of at least one hydraulic cylinder, wherein the linear movement of the cylinder is converted by the cable fastened to the inserting lance into a linear movement of the inserting lance.

Such a device has the drawback that a large amount of hydraulic liquid is required to force the inserting lance over its whole length into the ground by extending the cylinder.

A possible solution is to make use of slimline cylinders with a small volume of hydraulic liquid in the fully extended situation. The drawback here however is that the power delivered by the cylinder during insertion of the inserting lance is limited.

The invention has for its object to obviate the above stated drawbacks and provides for this purpose a device which is distinguished in that the inserting lance is driven by means of the or each drive member embodied as a closed loop of a flexible element, wherein the one part of the closed loop co-acts with the transmission and the other part of the loop is fixed to the inserting lance.

A device assembled according to the invention has the advantage that it can insert the inserting lance, and therefore the drainage wick received in the inserting lance, into the ground in a shorter time than a device known in the art.

The invention is further elucidated on the basis of the figure description following hereinbelow of an embodiment of the invention. In the drawing.

Figure 1:
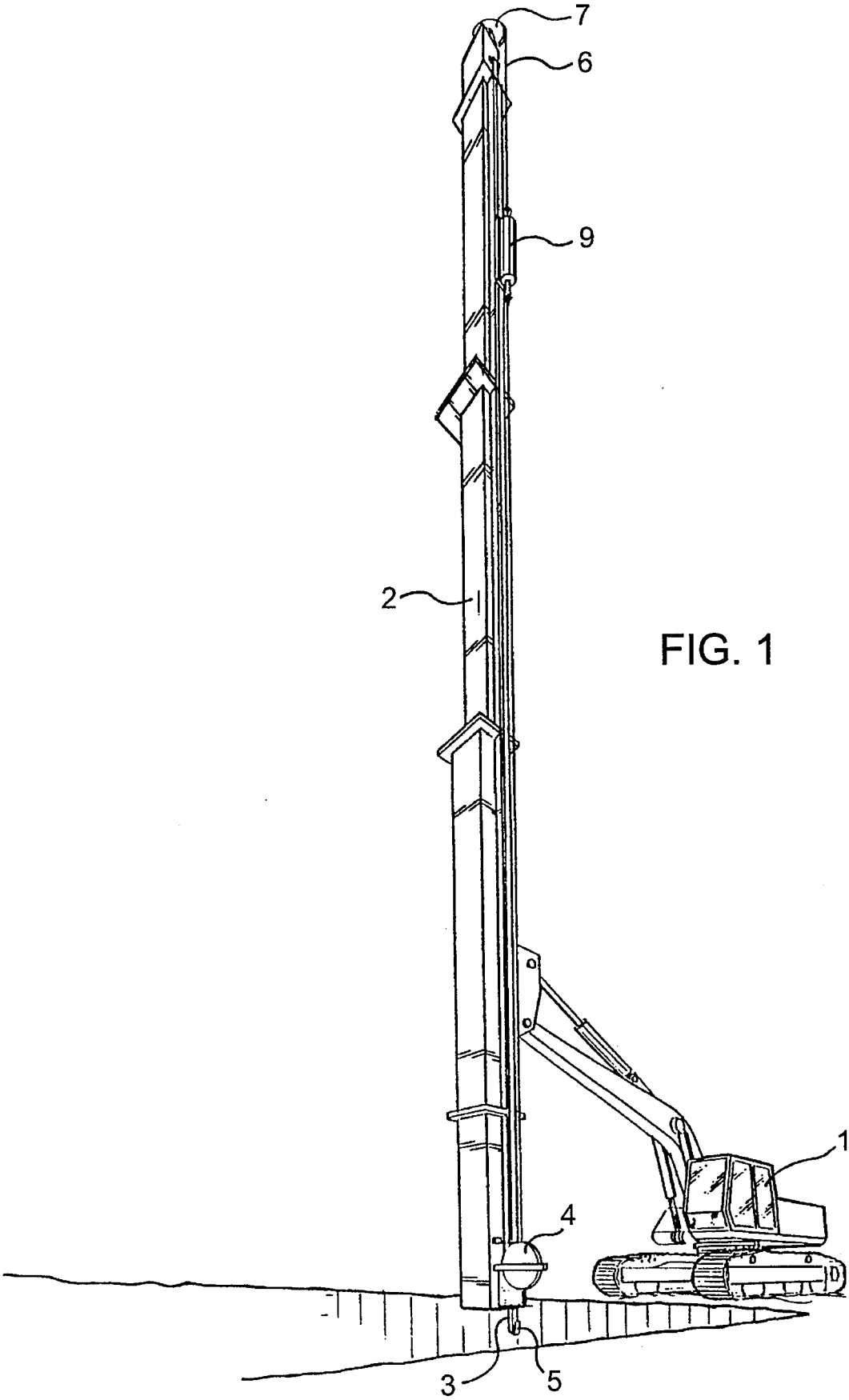
FIG. 1 shows a perspective view of a device according to the invention.

The embodiment of the invention shown in FIG. 1 comprises: a frame formed by a hydraulic crane 1; a guide 2 of stepped design; an inserting lance 3; and a supply means 4 for the drainage wick 5; and a drive member embodied as cable 6.

Guide 2 is fixed for tilting on the hydraulic crane 1, whereby the device is suitable for transport with the guide 2 in a position lying on the crane 1, and the device is suitable for inserting the drainage wick 5 with the guide 2 in a standing position.

Drainage wick 5 is inserted into the ground by moving the inserting lance 3 in downward direction through the guide 2 placed in a standing position on the ground, using the cable 6 formed to a closed loop and fastened to inserting lance 3, wherein drainage wick 5 is received in inserting lance 3.

Guide 2 is provided with reversing wheels 7 and 8 respectively on the top and bottom of guide 2, wherein cable 6 is trained round these reversing wheels 7 and 8. Cable 6 forms a closed loop in that the ends of cable 6 are connected to fastening element 9. The one part of the loop formed in this way runs through the guide 2 and the other part, which contains the fastening element 9, runs along the outside of guide 2, wherein fastening element 9 is fixed to the inserting lance 3. This will be described further hereinbelow. The inserting lance 3 is therefore set into movement by moving the cable 6, formed to a closed loop, over the reversing wheels 7 and 8.

Figure 2:
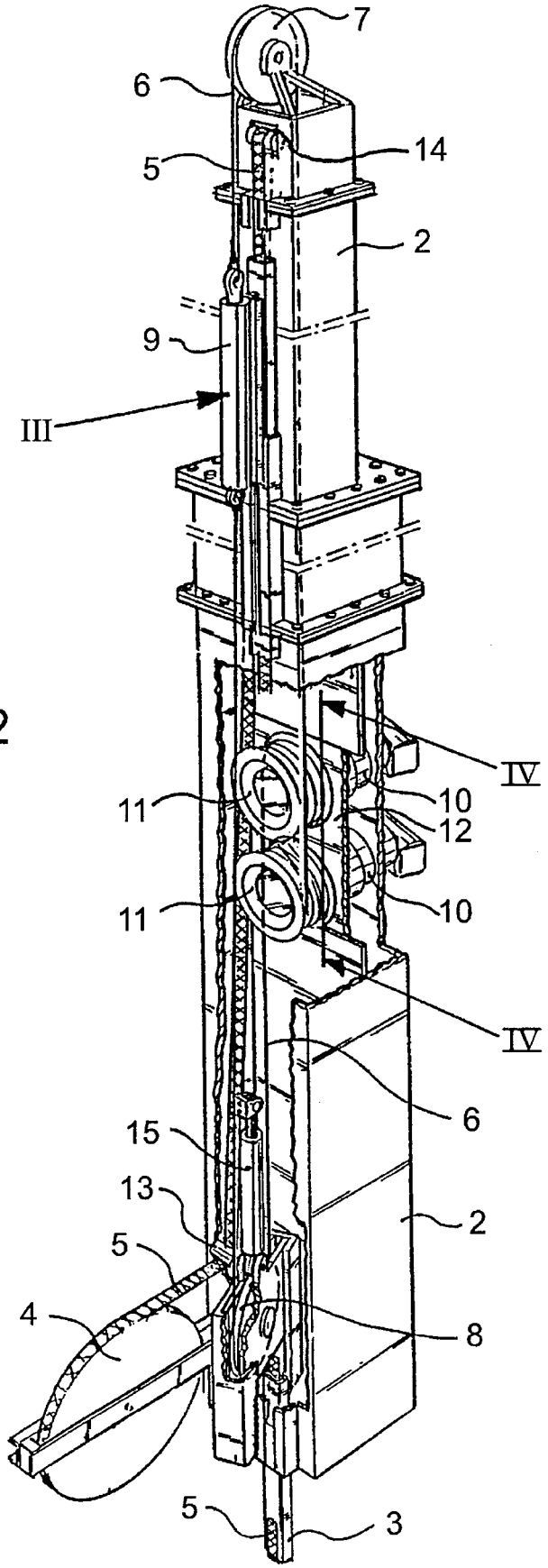
FIG. 2 shows a partly cut away perspective view of a guide of the device of FIG. 1.

The partially cut away perspective view shown in FIG. 2 of a guide of the device of FIG. 1 further comprises: a drive formed by hydromotors 10; and a transmission formed by drums 11.

The drums 11 are coupled to hydromotors 10 by means of drive shafts 23, wherein drive shafts 23 protrude through support plate 12. The hydromotors 10 are driven by means of the hydraulic system of crane 1, whereby a rotating movement of drums 11 is caused. The drums 11 are provided, just as the reversing wheels 7 and 8, with grooves in the surface for receiving the cable 6 formed to a closed loop. Cable 6 is trained round the drums 11 in the one part of the closed loop, whereby the rotating movement of drums 11 is converted into a linear movement of cable 6, and therefore likewise into a linear movement of inserting lance 3. This will be further described below.

Both rotation axes of drums 11 corresponding with the drive shafts 23 each lie in a direction perpendicular to the longitudinal axis of guide 2, wherein a plane containing both rotation axes makes an acute angle with the longitudinal axis of guide 2. Thus ensured is that the portions of the cable 6 in the interior of guide 2 which are not trained round a drum move at a distance from an adjacent drum when the hydromotors are set into operation, i.e. these portions of cable 6 do not in this case scrape against a drum 11 or another portion of cable 6 trained round a drum.

The drainage wick 5 is placed in rolled-up state in a supply means 4 for the drainage wick 5 on the underside of guide 2 and is unrolled from the a supply means 4 during insertion of the drainage wick 5. Drainage wick 5 is carried through inlet opening 13 to the interior on the underside of guide 2, guided to the top of guide 2 and there carried through outlet opening 14 to the outside of guide 2, where drainage wick 5 is taken up into the inserting lance 3. New drainage wick 5 is therefore taken up directly into the inserting lance 3 when the latter is moved in upward direction out of the ground after insertion of drainage wick, so that after raising of inserting lance 3 the device can immediately be used again for insertion of a drainage wick at another location.

The cable 6 formed to a closed loop and trained round reversing wheels 7 and 8 is placed under tension using the tensioning element 15 which is fixed on one side to the shaft of the reversing wheel 8 and is fixed thereabove on the other side to guide 2. Using tensioning element 15 the distance is adjusted between the reversing wheel 8 and the reversing wheel 7 fixedly attached to the upper part of guide 2, and the tension in the cable 6 formed to a closed loop can therefore be determined.

Figure 3:
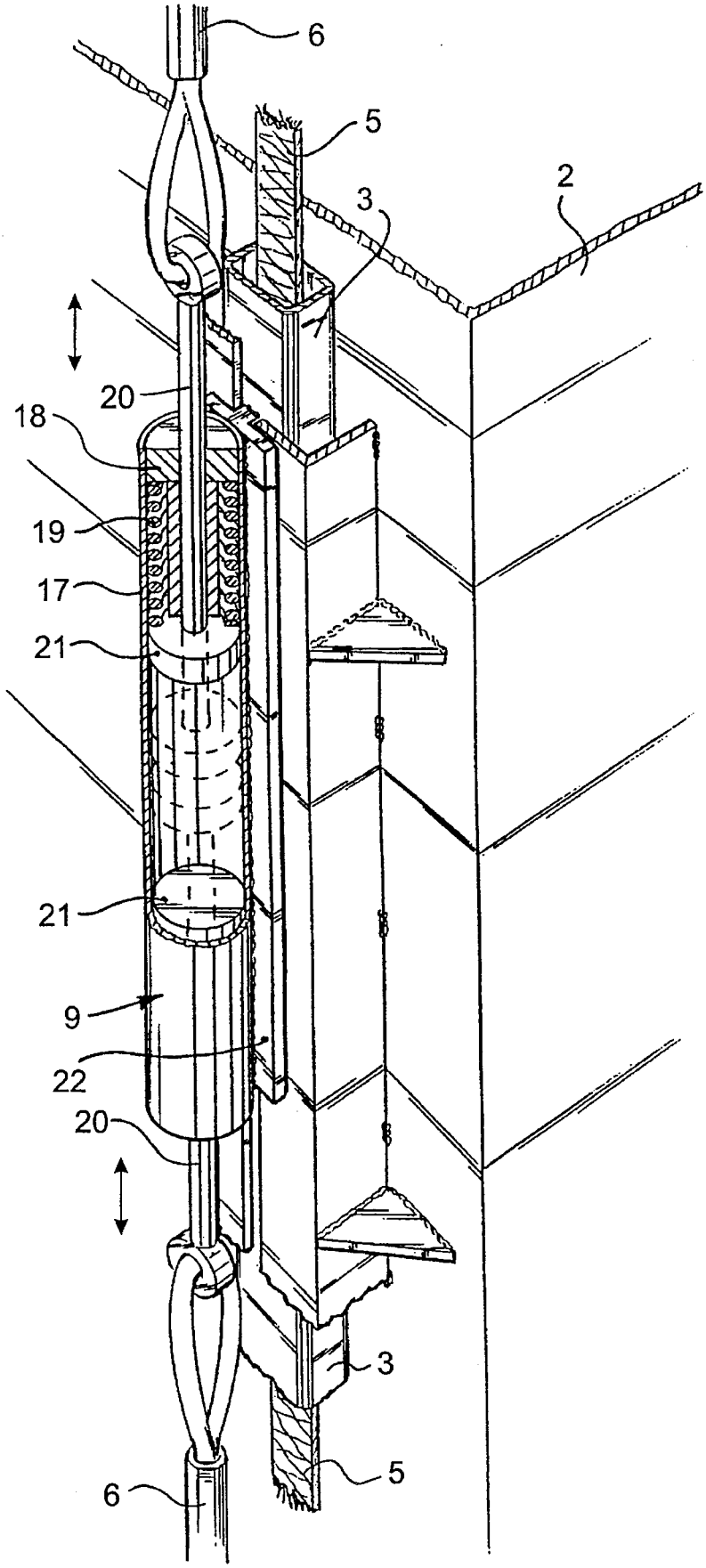
FIG. 3 is a partly cut away perspective view of a detail III in FIG. 2.

Shown in FIG. 3 is a partly cut away perspective view of detail III of FIG. 2. The fastening element 9 is formed by a cylinder 17, wherein the open ends of cylinder 17 are closed by means of end closures 18 each provided in the middle with a hole. Protruding through each hole is a pin 20 which is fixed to cable 6 on the side outside cylinder 17 and wherein a disc 21 corresponding with the inner dimension of cylinder 17 is arranged on the end of pin 20 in the interior of cylinder 17. Springs 19 are placed between discs 21 and end closures 18 so that the spring force exerts a force on the ends of cable 6 acting in the direction of the interior of fastening element 9. Springs 19 damp the shock of the inserting lance 3 being set into movement and likewise damp the vibrations occurring during insertion of the inserting lance 3.

The cylinder 17 is fixed over its whole length to a plate 22 which has a dimension corresponding with the length of cylinder 17. Plate 22 is fixed to inserting lance on the top of inserting lance 3.

Figure 4:
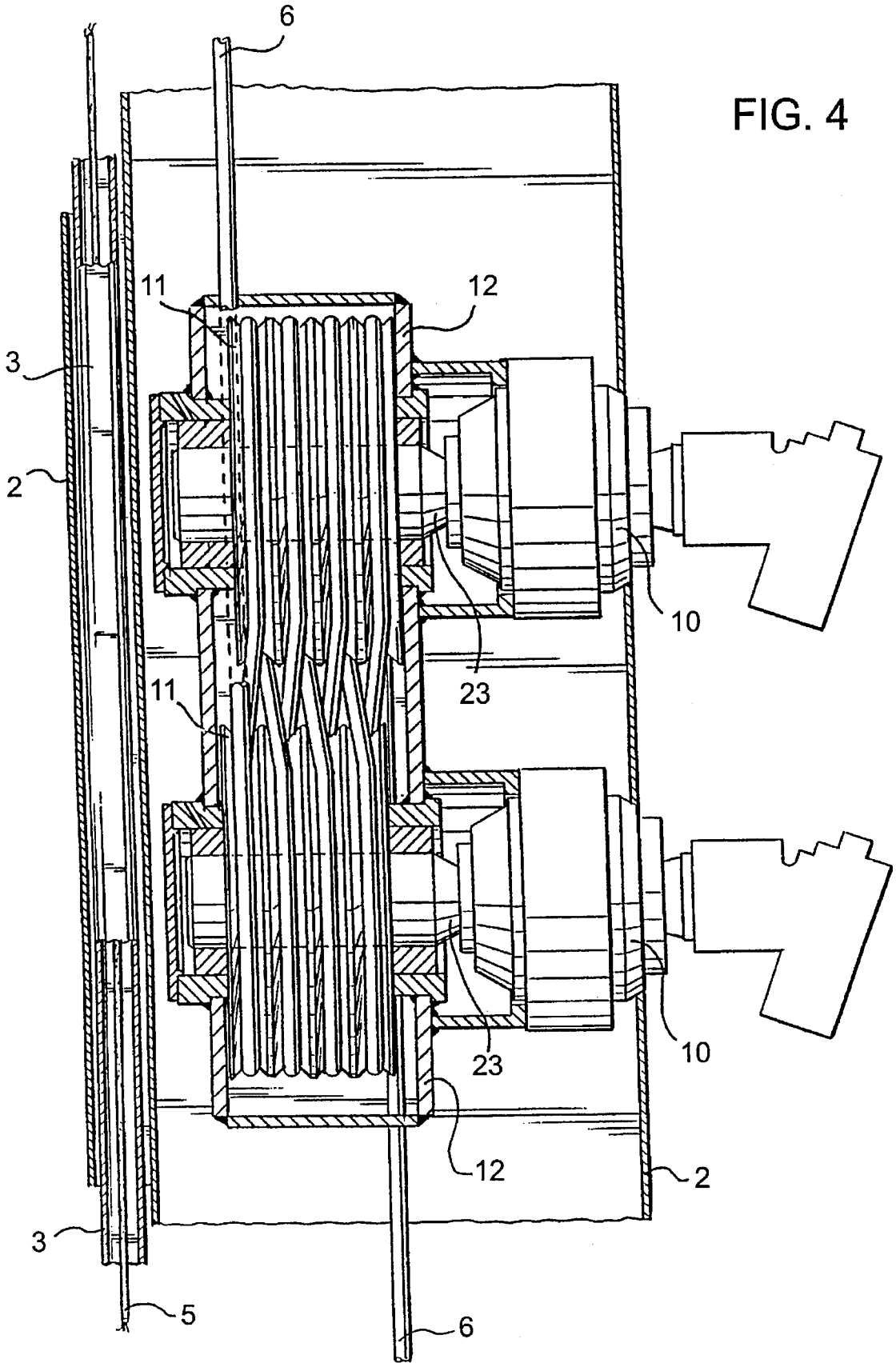
FIG. 4 is a view of a detail IV—IV in FIG. 2.

In FIG. 4 is shown a view of detail IV—IV in FIG. 2. The hydromotors 10 are placed in the interior of guide 2 between the wall of guide 2 and the support plate 12 and drive the drums 11 using drive shafts 23 protruding through support plate 12. The cable 6 is trained a number of times in the form of a figure eight round the drums 11 in grooves in the periphery of the drums 11, whereby the rotatably driven movement of drums 11 is converted into a linear up or downward movement of cable 6. In another embodiment according to the invention the cable 6 is trained in an oval shape round the drums 11.

I claim:

1. Device for inserting in each case a substantially vertical drainage wick, which device comprises:

a movable frame;

an inserting lance which is provided with a passage for receiving the drainage wick and corresponding with the longitudinal axis of the inserting lance;

a standing guide for the inserting lance supported by the frame;

a supply means for arranging the drainage wick in unwindable manner;

a drive;

a transmission connected to the drive; and at least one drive member co-acting with the transmission, characterized in that the inserting lance is driven by means of the at least one drive member embodied as a closed loop of a flexible element, wherein one part of the closed loop co-acts with the transmission and another part of the loop is fixed to the inserting lance;

wherein the transmission is formed by at least one wheel driven rotatably on a lying shaft; and wherein the at least one wheel is embodied as a drum around which the flexible element is trained a number of times.

2. Device as claimed in claim 1, characterized in that the transmission is formed by at least two adjacent drums.

3. Device as claimed in claim 2, characterized in that each drum is provided with grooves around which the flexible element is trained.

4. Device as claimed in claim 2, characterized in that the flexible element is trained in the form of a figure eight round the transmission formed by two drums.

5. Device as claimed in claim 1, characterized in that the drive is formed by at least one hydromotor.

6. Device as claimed in claim 1, characterized in that the guide is provided on the top side and on the underside with reversing wheels round which the flexible element is trained, wherein at least one of the reversing wheels is fixed to the guide by means of a tensioning element.

7. Device as claimed in claim 1, characterized in that the flexible element is closed to a loop by means of a fastening element in the other part, wherein the fastening element is fixed to the inserting lance.

8. Device as claimed in claim 7, characterized in that the fastening element closing the loop comprises a sleeve fixed to the lance and the ends of the flexible element are under tension of at least one spring arranged in the sleeve.

9. Device for inserting in each case a substantially vertical drainage wick, which device comprises:

a movable frame;

an inserting lance which is provided with a passage for receiving the drainage wick and corresponding with the longitudinal axis of the inserting lance;

a standing guide for the inserting lance supported by the frame;

a supply means for arranging the drainage wick in unwindable manner;

a drive;

a transmission connected to the drive; and at least one drive member co-acting with the transmission, characterized in that the inserting lance is driven by means of the at least one drive member embodied as a closed loop of a flexible element, wherein one part of the closed loop co-acts with the transmission and a second part of the loop is fixed to the inserting lance;

wherein the flexible element is closed to a loop by means of a fastening element in the second part;

wherein the fastening element is fixed to the inserting lance; and wherein the fastening element closing the loop comprises a sleeve fixed to the lance and the ends of the flexible element are under tension by at least one spring arranged in the sleeve.

* * * * *